US011020971B2

(12) United States Patent
Minami et al.

(10) Patent No.: US 11,020,971 B2
(45) Date of Patent: Jun. 1, 2021

(54) LIQUID EJECTION HEAD

(71) Applicant: CANON KABUSHIKI KAISHA, Tokyo (JP)

(72) Inventors: Seiko Minami, Warabi (JP); Kenji Takahashi, Yokohama (JP); Masaya Uyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 47 days.

(21) Appl. No.: 16/669,922

(22) Filed: Oct. 31, 2019

(65) Prior Publication Data

US 2020/0147962 A1 May 14, 2020

(30) Foreign Application Priority Data

Nov. 8, 2018 (JP) ..... JP2018-210574

(51) Int. Cl.
*B41J 2/14* (2006.01)

(52) U.S. Cl.
CPC ..... *B41J 2/1433* (2013.01)

(58) Field of Classification Search
CPC ..... B41J 2/1433
See application file for complete search history.

(56) References Cited

U.S. PATENT DOCUMENTS 10,525,709 B2 * 1/2020 Sato ..... B41J 2/1606
2012/0098896 A1 * 4/2012 Nihei ..... B41J 2/14233 347/68

FOREIGN PATENT DOCUMENTS

JP 2017-1326 A 1/2017

* cited by examiner

*Primary Examiner* — Justin Seo
(74) *Attorney, Agent, or Firm* — Venable LLP

(57) ABSTRACT

A liquid ejection head including an orifice plate including an ejection orifice, an element substrate including an energy-generating element, and a flow path wall member for formation of a flow path, the flow path wall member being disposed between the element substrate and the orifice plate, wherein the orifice plate includes a first surface and a second surface which is opposite to the first surface and which is disposed facing the element substrate, the first surface includes a first diamond-like carbon film, respective contact angles $\theta_1$ and $\theta_2$ to pure water, of the first surface and the second surface, satisfy a relationship of Expression 1 defined in the specification, and composition in the first surface of the first diamond-like carbon film satisfies all relationships of Expression 2 to Expression 5 defined in the specification.

13 Claims, 5 Drawing Sheets

LIQUID EJECTION HEAD

BACKGROUND OF THE INVENTION

Field of the Invention

The present invention relates to a liquid ejection head.

Description of the Related Art

As a conventional liquid ejection head, the following liquid ejection head is disclosed in Japanese Patent Application Laid-Open No. 2017-1326. The liquid ejection head includes an element substrate which includes an energy-generating element on a first surface and which is provided with a liquid supply path penetrating from the first surface to a second surface, and an ejection orifice forming member which is provided with a flow path in communication with the liquid supply path and an ejection orifice for ejection of a liquid from the flow path outward, on a first surface. The ejection orifice forming member is then provided with a plate-shaped first member where the ejection orifice is formed, and a second member for defining a wall portion of the flow path, in which the first member is formed by an inorganic film including diamond-like carbon (DLC). Thus, the first member is composed of the inorganic film including DLC, thereby allowing the surface of the ejection orifice to secure strength and flatness, in Japanese Patent Application Laid-Open No. 2017-1326.

SUMMARY OF THE INVENTION

The present invention relates to a liquid ejection head including an orifice plate including an ejection orifice which ejects a liquid, an element substrate including an energy-generating element for ejection of a liquid from the ejection orifice and a flow path wall member for formation of a flow path in communication with the ejection orifice, the flow path wall member being disposed between the element substrate and the orifice plate, wherein the orifice plate includes a first surface and a second surface which is opposite to the first surface and which is disposed facing the element substrate, the first surface includes a first diamond-like carbon film, respective contact angles $\theta_1$ and $\theta_2$ to pure water, of the first surface and the second surface, satisfy a relationship of the following Expression 1, and composition in the first surface of the first diamond-like carbon film satisfies all relationships of the following Expression 2 to Expression 5.

$$\theta_2<\theta_1<100° \quad \text{Expression 1:}$$

$$0 \text{ at } \% \leq x1 \leq 50 \text{ at } \% \quad \text{Expression 2:}$$

$$0 \text{ at } \% \leq y1 \leq 70 \text{ at } \% \quad \text{Expression 3:}$$

$$0 \text{ at } \% \leq z1 \leq 70 \text{ at } \% \quad \text{Expression 4:}$$

$$x1+y1+z1=100 \text{ at } \% \quad \text{Expression 5:}$$

wherein x1, y1 and z1 represent content rates of $sp^3$ hybrid orbital species, $sp^2$ hybrid orbital species and a hydrogen atom in the first diamond-like carbon film, respectively.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The liquid ejection head described in Japanese Patent Application Laid-Open No. 2017-1326 uses DLC in the first member (hereinafter, referred to as "orifice plate") where the ejection orifice is formed. Thus, the first member can also have water repellency on a surface thereof, the surface being in contact with the flow path (in particular, a foaming chamber). In the case where the first member has water repellency, a concern is that air bubbles are easily accumulated in the foaming chamber to result in an unstable amount of ejection of a liquid and deterioration in printing quality.

Accordingly, an object of the present invention is to provide a liquid ejection head which can be suppressed in air bubble accumulation in a foaming chamber to thereby allow a stable amount of ejection of a liquid and an excellent printing quality to be achieved.

<Liquid Ejection Head>

The liquid ejection head of the present invention can be mounted in not only a printer, a copier, or a facsimile having a communication system, but also an industrial recording apparatus compositely combined with various processing apparatuses. While the following description may be made with focusing on an inkjet recording head as the liquid ejection head, the present invention is not limited to such a mode.

Figure 1:
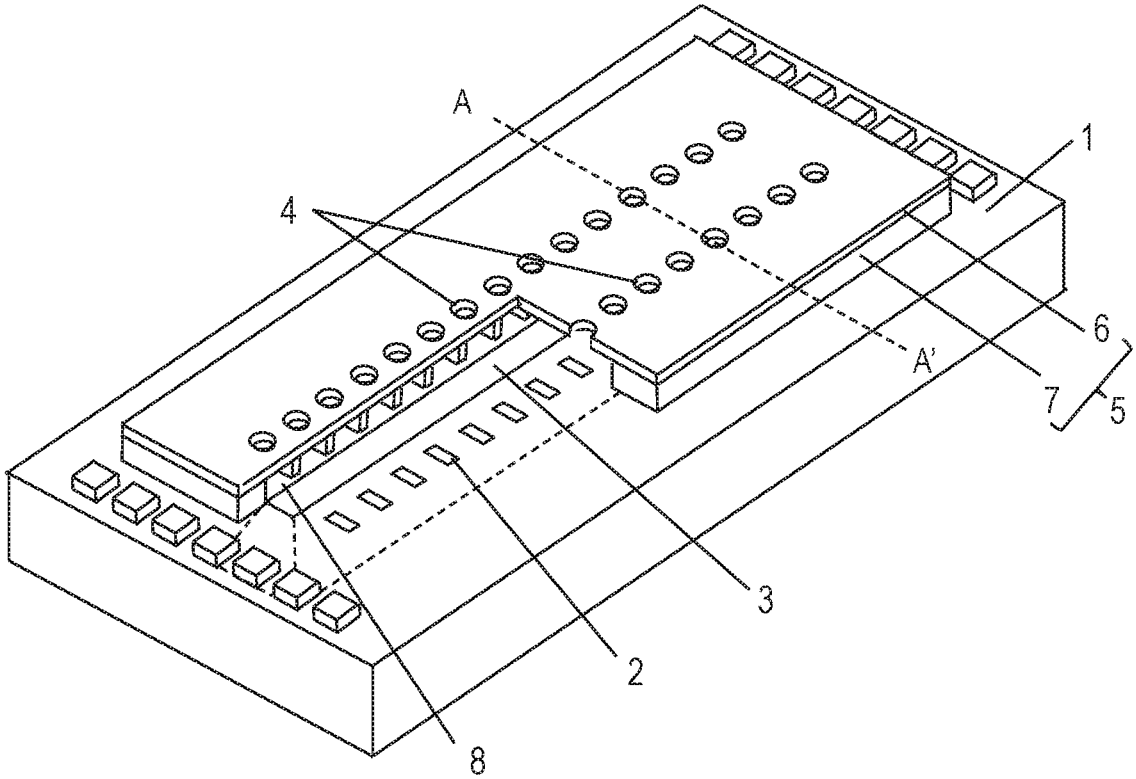
FIG. 1 is a schematic perspective view of a state where one embodiment of the liquid ejection head of the present invention is partially broken-out.
Figure 2A:
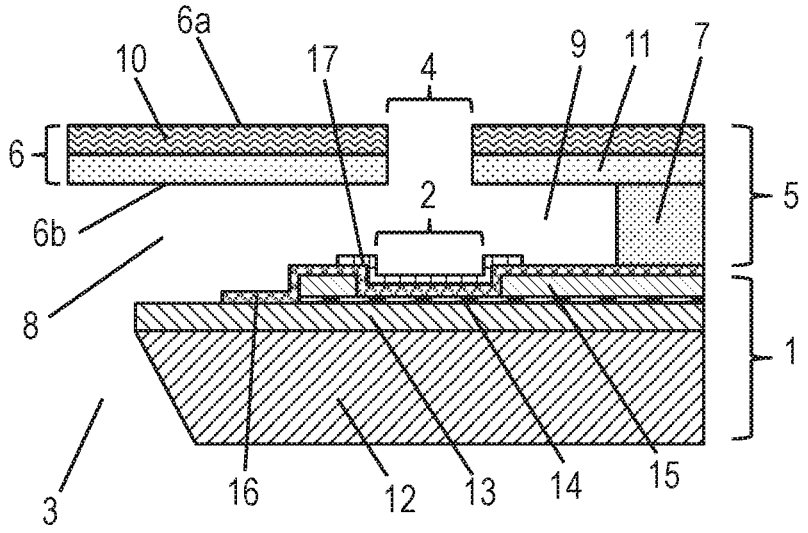
FIG. 2A is a schematic partial cross-sectional view illustrating a plurality of embodiments of the liquid ejection head of the present invention.
Figure 2B:
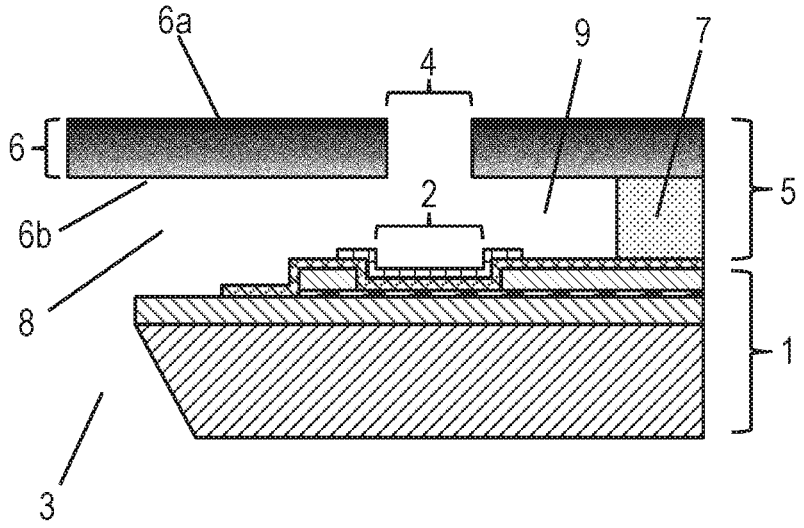
FIG. 2B is a schematic partial cross-sectional view illustrating a plurality of embodiments of the liquid ejection head of the present invention.

Hereinafter, the liquid ejection head of the present invention will be described in detail with reference to FIG. 1, FIG. 2A and FIG. 2B. Herein, FIG. 1 is a schematic perspective view of a state where one embodiment of the liquid ejection head of the present invention is partially broken-out. FIG. 2A and FIG. 2B are each a schematic partial cross-sectional view illustrating a plurality of embodiments of the liquid ejection head of the present invention, in which the cross-sectional view corresponds to a cross-sectional view of a portion of the head cut in a line A-A' illustrated in FIG. 1.

As illustrated in such Figures, the liquid ejection head of the present invention includes an orifice plate 6 defining an (liquid) ejection orifice 4, an element substrate 1 including an energy-generating element 2 and a flow path wall member 7 defining a wall portion of a (liquid) flow path 8. The flow path wall member 7 is here disposed between the element substrate 1 and the orifice plate 6. Hereinafter, the orifice plate 6 and the flow path wall member 7 may be collectively referred to as "nozzle layer 5" in some cases.

Hereinafter, each member included in the liquid ejection head will be described in detail.

(Element Substrate)

A element substrate 1 includes an energy-generating element 2 for ejection of a liquid (for example, a recording liquid such as ink) from an ejection orifice 4, as illustrated in FIG. 1, FIG. 2A and FIG. 2B. The element substrate 1 can also include a liquid supply port 3 which is in communication with a flow path 8 and which supplies a liquid.

For example, a silicon substrate can be used as a substrate 12 for use in the element substrate. Hereinafter, one surface of two opposite surfaces of the element substrate (substrate 12), where the flow path wall member 7 is disposed, may be referred to as a "front surface" and another surface thereof opposite to the front surface may be referred to as a "rear surface".

The energy-generating element 2 is not particularly limited, and, for example, an electrothermal conversion element (a heat-generating resistor element or a heater element) which boils a liquid, by which the above effect of the present invention is more obtained, can be used as the energy-generating element. An element or the like (a piezo element or a piezoelectric element) which applies any pressure to a liquid due to the change in volume and/or due to vibration, however, may also be used as the energy-generating element. The energy-generating element 2 may be provided so as to be in contact with the front surface of the element substrate 1, or may be provided so as to be partially separated from the front surface of the element substrate 1.

The energy-generating element can be appropriately selected with respect to the number and the location thereof, depending on the structure of a liquid ejection head to be produced, and, for example, a plurality of such elements aligned at a predetermined pitch in a row of elements can be provided on each of both sides of the liquid supply port 3.

The liquid supply port 3 which can be included in the element substrate penetrates through the element substrate 1 in a direction substantially perpendicular to the substrate surface, and is opened on the two opposite surfaces of the element substrate. The shape of the liquid supply port is not particularly limited, and, for example, can be tapered so that the opening surface area is decreased toward the front surface from the rear surface of the element substrate.

As illustrated in FIG. 2A, a cavitation-resistant film 17 which protects the energy-generating element 2 (specifically, a heater layer 14) from a liquid, an insulating protection film 16, a heat accumulating layer 13, a wiring layer 15, a drive circuit (not illustrated) and the like can be located on the substrate 12.

(Flow Path Wall Member)

The flow path wall member 7 disposed between the element substrate 1 and the orifice plate 6 is provided for forming the flow path 8 in communication with the ejection orifice 4 and for defining the shape of the flow path 8. The flow path 8 includes a foaming chamber (liquid chamber) 9. The foaming chamber 9 instantly heats the energy-generating element 2 (for example, a heater element) and thus generates air bubbles in a liquid supplied through the liquid supply port 3 to the flow path 8, thereby allowing the liquid to be ejected from the ejection orifice. The material included in the flow path wall member is not particularly limited, and can be appropriately set depending on the respective materials included in the element substrate 1 and the orifice plate 6 in contact with the flow path wall member. The flow path wall member 7, for example, may include an organic material or an inorganic material, and may include a photosensitive material or a non-photosensitive material. The flow path wall member 7 may include the same material as in a portion (for example, a second layer 11 described below) of the orifice plate 6, or may include a material different from the material of the orifice plate 6.

(Orifice Plate)

The ejection orifice 4 included in the orifice plate 6 is provided for ejecting a liquid, and, for example, as illustrated in FIG. 2A, can be formed in a section of the orifice plate, the section being located above the energy-generating element 2 (illustrated in the upper of the Figure), and is usually formed with a plurality thereof being provided per liquid ejection head.

As illustrated in FIG. 2A and FIG. 2B, the orifice plate 6 includes a first surface 6*a* and a second surface 6*b* which is opposite to the first surface 6*a* and which is disposed facing the element substrate, and the first surface 6*a* includes a first diamond-like carbon film (DLC film).

The respective contact angles $\theta_1$ and $\theta_2$ to pure water, of the first surface 6*a* and the second surface 6*b*, satisfy a relationship of the following Expression 1, and the composition in the first surface 6*a* of the first diamond-like carbon film satisfies all relationships of the following Expression 2 to Expression 5.

$$\theta_2<\theta_1<100° \quad \text{Expression 1:}$$

$$0 \text{ at } \% \leq x1 \leq 50 \text{ at } \% \quad \text{Expression 2:}$$

$$0 \text{ at } \% \leq y1 \leq 70 \text{ at } \% \quad \text{Expression 3:}$$

$$0 \text{ at } \% \leq z1 \leq 70 \text{ at } \% \quad \text{Expression 4:}$$

$$x1+y1+z1=100 \text{ at } \% \quad \text{Expression 5:}$$

wherein x1, y1 and z1 represent content rates of $sp^3$ hybrid orbital species, $sp^2$ hybrid orbital species and a hydrogen atom in the first diamond-like carbon film, respectively.

The respective contact angles $\theta_1$ and $\theta_2$ to pure water, of the first surface and the second surface, can be specified by a method for measuring the contact angle to pure water. The composition in the first surface of the first DLC film can be specified by use of a Raman spectrometric method.

Figure 4A:
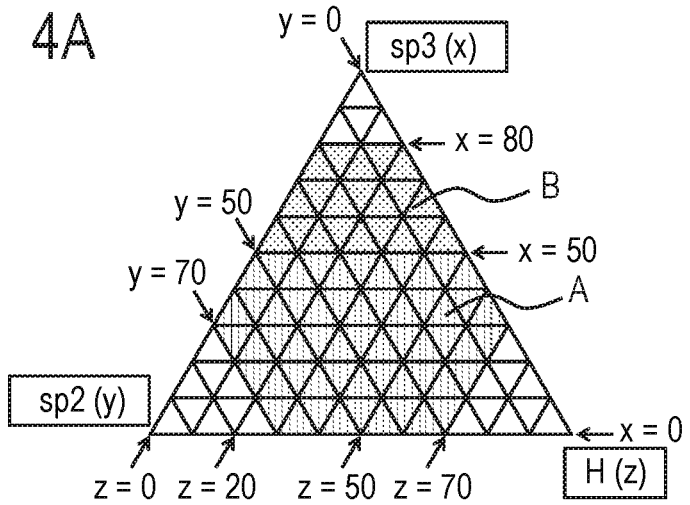
FIG. 4A is a view for describing the composition of diamond-like carbon which can be used in an orifice plate of the liquid ejection head of the present invention.
Figure 4B:
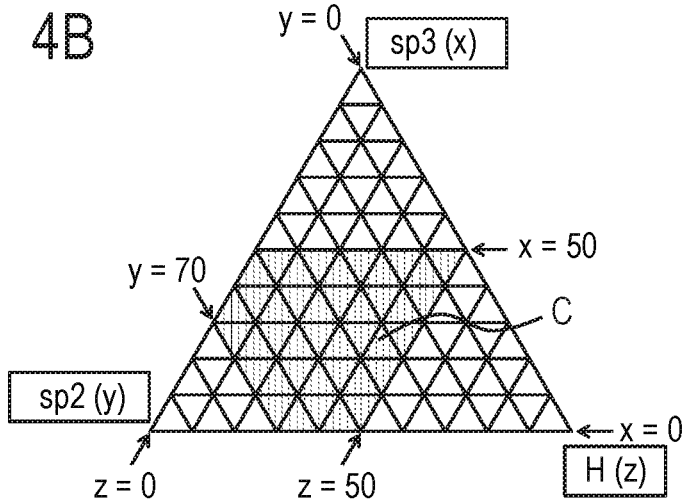
FIG. 4B is a view for describing the composition of diamond-like carbon which can be used in an orifice plate of the liquid ejection head of the present invention.
Figure 4C:
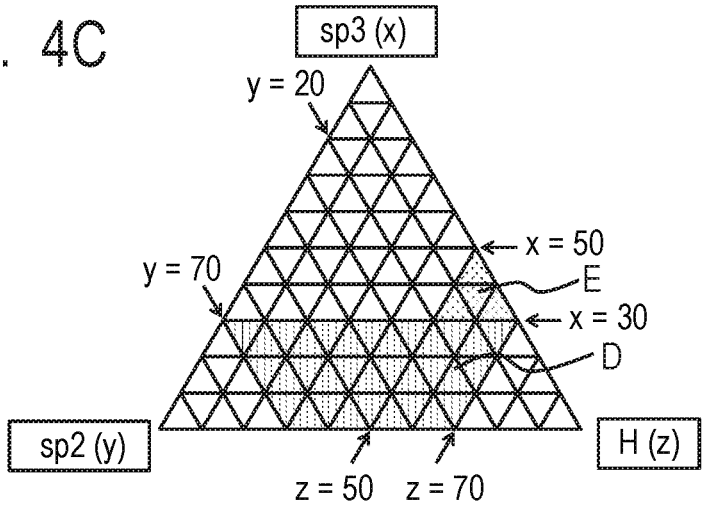
FIG. 4C is a view for describing the composition of diamond-like carbon which can be used in an orifice plate of the liquid ejection head of the present invention.

As long as the above requirements are satisfied, the orifice plate 6 may include a plurality of layers (for example, a first layer 10 (first DLC film) and a second layer 11), as illustrated in FIG. 2A. Alternatively, the orifice plate 6 may include a mono-layer where the first surface 6*a* and the second surface 6*b* are different in composition, as illustrated in FIG. 2B. That is, inside layer(s) included in the orifice plate may be different in composition as long as the above requirements are satisfied. Hereinafter, each of the requirements to be satisfied by the orifice plate 6 will be described in detail. FIGS. 4A to 4C here each illustrate a ternary phase diagram as a conceptual diagram of the DLC film. FIGS. 4A to 4C illustrate a case where the vertex at the top of the diagram represents a content rate of $sp^3$ hybrid orbital species, of 100 at %, a case where the vertex at the bottom left of the diagram represents a content rate of $sp^2$ hybrid orbital species, of 100 at %, and a case where the vertex at the bottom right of the diagram represents a content rate of a hydrogen atom, of 100 at %, respectively. The composition to be satisfied by the first DLC film corresponds to a region indicated by symbol A in FIG. 4A.

As described above, the first surface 6*a* of the orifice plate includes the first DLC film. DLC is chemically stable and thus is less transformed and/or fixed due to a liquid for use in the liquid ejection head. Thus, the variation in surface energy on the first surface 6*a* of the orifice plate can be suppressed.

A DLC film is known to contain carbon having an $sp^3$ bond corresponding to a diamond structure and carbon having an $sp^2$ bond corresponding to a graphite structure, which are irregularly mixed, and is also known to be significantly varied in physical properties depending on the content of hydrogen thereof.

The content rate x1 of $sp^3$ hybrid orbital species in the first DLC film satisfies the Expression 2 and is 0 at % or more and 50 at % or less. In the case the content rate x1 is 50 at % or less, the contact angle to pure water is increased and meniscus is easily stabilized. Such a case also allows for easy wiping off and removal of any unnecessary droplet generated during printing and attached onto the first surface 6*a*. The content rate y1 of $sp^2$ hybrid orbital species and the content rate z1 of a hydrogen atom, in the first DLC film, are here needed to satisfy the Expression 3 and the Expression 4, respectively, and to be 0 at % or more and 70 at % or less. In the case where the rates are more than 70 at %, the contact angle to pure water is 100° or more, and any unnecessary droplet generated during printing cannot be attached onto and then remain on the first surface 6*a* and may drop on a print product. In other words, the contact angle $\theta_1$ to pure water of the first surface 6*a* is needed to satisfy the Expression 1 and to be less than 100°. The contact angle $\theta_1$ to pure water of the first surface is preferably more than 60° from the viewpoint of meniscus.

The total of x1, y1 and z1 here satisfies the Expression 5 and is 100 at %.

The second surface 6*b* of the orifice plate 6 is smaller in contact angle to pure water than the first surface 6*a* and satisfies the relationship of the Expression 1 ($\theta_2<\theta_1$). The relationship is satisfied, thereby not only enabling strength and flatness, and furthermore water repellency and the like of a surface (first surface) of the ejection orifice of the liquid ejection head to be ensured, but also enabling air bubble accumulation in the foaming chamber to be suppressed. A larger difference ($\theta_1-\theta_2$) between both the contact angles is more preferable from the same viewpoint.

In the case where the orifice plate 6 includes a plurality of layers, as illustrated in FIG. 2A, the second surface can include a film (second layer 11) different from the first DLC film (first layer 10) included in the first surface.

The film included in the second surface is not particularly limited as long as the film satisfies the relationship of the Expression 1, and various materials can be used therefor. For example, the second surface may include a non-photosensitive material film or may include a photosensitive material film. The second surface may include an inorganic film or may include an organic film.

The non-photosensitive material film included in the second surface can include, for example, any material(s) described below. That is, the non-photosensitive material film can include at least one selected from the group consisting of diamond-like carbon, Si, SiC, SiCN, SOG (Spin on Glass) and polyimide.

In particular, the second surface preferably includes a second DLC film different from the first DLC film from the viewpoint of ejection performance and production stability. The composition in the second surface of the second DLC film preferably satisfies all relationships of the following Expression 6 to Expression 9.

$$50 \text{ at } \% \leq x2 \leq 80 \text{ at } \% \quad \text{Expression 6:}$$

$$0 \text{ at } \% \leq y2 \leq 50 \text{ at } \% \quad \text{Expression 7:}$$

$$0 \text{ at } \% \leq z2 \leq 50 \text{ at } \% \quad \text{Expression 8:}$$

$$x2+y2+z2=100 \text{ at } \% \quad \text{Expression 9:}$$

wherein x2, y2 and z2 represents content rates of $sp^3$ hybrid orbital species, $sp^2$ hybrid orbital species and a hydrogen atom in the second diamond-like carbon film, respectively. The composition in the second DLC film, satisfying the relationships, corresponds to a region indicated by symbol B in FIG. 4A, and is found not to be overlapped with a region indicated by symbol A. The composition in the second surface of the second DLC film can be specified by the same method as in the first DLC film described above.

The content rate x2 of $sp^3$ hybrid orbital species in the second DLC film is here 50 at % or more, thereby enabling the contact angle to pure water of the second surface to be easily smaller than the contact angle to pure water of the first surface. The content rate x2 is 80 at % or less, thereby easily imparting a proper hardness and easily preventing peeling or cracking of the orifice plate, warpage of the substrate and/or the like from being caused. The content rates y2 and z2 are 50 at % or less, thereby enabling stable meniscus to be easily formed on the ejection orifice. The total of x2, y2 and z2 here satisfies the Expression 9 and is 100 at %.

In the case where the second surface 6*b* includes the above non-photosensitive material film, the ejection orifice 4 may be formed according to dry etching. A non-volatile product (for example, a fluorinated product, any polymer or a residue of a photoresist mask material) is here formed on the surface subjected to the etching, and thus the non-volatile product is usually removed according to oxygen ashing. A DLC film high in the content of hydrogen is here easily reduced according to oxygen ashing. Thus, in the case where the second surface includes the non-photosensitive material film, the composition in the first surface of the first DLC film included in the first surface 6*a* preferably satisfies all relationships of the following Expression 10 to Expression 13.

$$0 \text{ at } \% \leq x1 \leq 50 \text{ at } \% \quad \text{Expression 10:}$$

$$0 \text{ at } \% \leq y1 \leq 70 \text{ at } \% \quad \text{Expression 11:}$$

$$0 \text{ at } \% \leq z1 \leq 50 \text{ at } \% \quad \text{Expression 12:}$$

$$x1+y1+z1=100 \text{ at } \% \quad \text{Expression 13:}$$

wherein x1, y1 and z1 represent content rates of $sp^3$ hybrid orbital species, $sp^2$ hybrid orbital species and a hydrogen atom in the first diamond-like carbon film, respectively.

The composition in the first DLC film, satisfying the relationships, corresponds to a region indicated by symbol C in FIG. 4B. The content of hydrogen in the first DLC film is thus 50 at % or less, thereby enabling film reduction due to oxygen ashing to be easily prevented even in formation of the ejection orifice by use of dry etching.

The photosensitive material film included in the second surface can include a positive type resist or a negative type resist. The first surface includes the first DLC film and the second surface includes such a resist, thereby allowing the contact angle of the second surface in contact with the foaming chamber to be easily small with the contact angle to pure water of the first surface being kept large. Thus, a liquid is easily spread into the foaming chamber and any bubbles are hardly accumulated.

The photosensitive material film usually includes a resin being an organic material, and thus tends to be high in linear coefficient of expansion as compared with a case of an inorganic material. Thus, in the case where the second surface includes the photosensitive material film, the difference in linear coefficient of expansion from the first DLC film included in the first surface may cause cracking and/or peeling-off of the orifice plate and warpage of the entire substrate to be generated. The DLC film is here increased in linear coefficient of expansion, as the content rate of $sp^3$ hybrid orbital species is decreased.

The DLC film can also be higher in linear coefficient of expansion by allowing the content rates of $sp^3$ hybrid orbital species, $sp^2$ hybrid orbital species and a hydrogen atom to be in specified relationships. Accordingly, in the case where the second surface includes the photosensitive material film, the composition in the first surface of the first DLC film preferably satisfies relationships of the following Expression 14 to Expression 17 or relationships of the following Expression 17 to Expression 20.

$$0 \text{ at } \% \leq x1 \leq 30 \text{ at } \% \quad \text{Expression 14:}$$

$$0 \text{ at } \% \leq y1 \leq 70 \text{ at } \% \quad \text{Expression 15:}$$

$$0 \text{ at } \% \leq z1 \leq 70 \text{ at } \% \quad \text{Expression 16:}$$

$$x1+y1+z1=100 \text{ at } \% \quad \text{Expression 17:}$$

$$30 \text{ at } \% \leq x1 \leq 50 \text{ at } \% \quad \text{Expression 18:}$$

$$0 \text{ at } \% \leq y1 \leq 20 \text{ at } \% \quad \text{Expression 19:}$$

$$50 \text{ at } \% \leq z1 \leq 70 \text{ at } \% \quad \text{Expression 20:}$$

wherein x1, y1 and z1 represent content rates of $sp^3$ hybrid orbital species, $sp^2$ hybrid orbital species and a hydrogen atom in the first diamond-like carbon film, respectively. The composition of the first DLC film satisfying the relationships of the Expressions 14 to 17 here corresponds to a region indicated by symbol D in FIG. 4C and the composition of the first DLC film satisfying the relationships of Expressions 17 to 20 here corresponds to a region indicated by symbol E in FIG. 4C. The first DLC film satisfies any of the relationships, thereby allowing the linear coefficient of expansion of the first DLC film to be approximated to the linear coefficient of expansion of the photosensitive material film included in the second surface. Accordingly, cracking and/or peeling-off of the above orifice plate and warpage of the entire substrate can be easily prevented.

As the linear coefficient of expansion of the DLC film is increased, the contact angle to pure water is increased. Accordingly, the orifice plate preferably has the following configuration in order to further suppress cracking and interface peeling-off of the orifice plate, and warpage of the entire substrate. That is, the contact angle to pure water, of the orifice plate 6, is preferably gradually decreased toward the second surface 6*b* from the first surface 6*a*. In other words, the orifice plate preferably has the configuration where the linear coefficient of expansion is gradually decreased toward the second surface from the first surface to result in a smaller difference in linear coefficient of expansion. For example, as illustrated in FIG. 2B, the orifice plate preferably includes a mono-layered (or multi-layered) DLC film where the contact angle to pure water is gradually decreased toward the second surface from the first surface.

The linear coefficient of expansion in each surface of the interior of the orifice plate or the orifice plate can be herein specified by a thermomechanical analysis (TMA) method. The contact angle to pure water of the interior of the orifice plate can be specified by a drop method.

The thickness of the entire orifice plate is preferably thinner from the viewpoint of a reduction of a satellite droplet separated from a main droplet. In such a case, the second surface preferably includes an inorganic film containing diamond-like carbon, SiC, SiCN or the like. The thickness of the orifice plate is here preferably 5 or less. The thickness of the orifice plate is preferably 2 μm or more from the viewpoint of mechanical strength.

The thickness of the entire orifice plate is preferably thicker from the viewpoint of an increase in the amount of ejection. In such a case, the second surface preferably includes an organic film (for example, a photosensitive material film) containing Si, SOG, polyimide or the like. The thickness of the orifice plate is here preferably 5 μm or more, more preferably 10 μm or more. The thickness of the orifice plate is preferably 20 μm or less from the viewpoint of peeling, and warpage of the substrate.

The film (for example, the non-photosensitive material film or the photosensitive material film) included in the second surface preferably has a thickness of 1 μm or more in the second surface from the viewpoint of allowing bubbles to be hardly accumulated in the foaming chamber.

<Method of Using Liquid Ejection Head>

In the case where the liquid ejection head is used to perform recording onto a recording medium such as paper, a surface of the head, i.e. a surface (ejection orifice surface) where the ejection orifice is formed, is disposed so as to face a recording surface of the recording medium. Printing (recording) can be then performed by allowing a liquid supplied through the liquid supply port 3 to pass through the flow path 8, applying energy from the energy-generating element 2 located inside the foaming chamber 9, to the liquid, ejecting the liquid through the ejection orifice 4, and landing the liquid onto a recording medium.

<Method for Producing Liquid Ejection Head>

A method for producing the liquid ejection head of the present invention can include, for example, the following steps:

- a step of preparing an element substrate 1 including an energy-generating element 2 (element substrate preparation step); and
- a step of forming a nozzle layer 5 on the element substrate (nozzle layer formation step).

The element substrate preparation step can include a step of forming a liquid supply port. In the above production method, the nozzle layer may be formed by each forming an orifice plate 6 and a flow path wall member 7 on a support substrate and pasting the resultant onto the element substrate, in the nozzle layer formation step. Alternatively, the nozzle layer may be formed by each forming a flow path wall member and an orifice plate on the element substrate in the nozzle layer formation step.

The order of such steps is not particularly limited, and such steps may be sequentially performed or a plurality of steps (for example, a flow path wall member formation step and an orifice plate formation step) may be performed in parallel. One example of the above production method is described in detail with reference to FIGS. 3A to 3F. An embodiment illustrated in FIGS. 3A to 3F is a mode where an orifice plate 6 includes a plurality of layers of a first layer 10 (first DLC film) and a second layer 11. In the embodiment, a liquid ejection head is produced by forming an orifice plate and a flow path wall member on a support substrate in advance and pasting the resultant onto an element substrate.

Figure 3A:
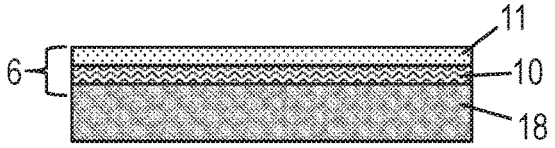
FIG. 3A is a schematic cross-sectional process flow for describing each step of a method for producing one embodiment of the liquid ejection head of the present invention.

As illustrated in FIG. 3A, first, a support substrate 18 is prepared. The support substrate 18, on which a first DLC film included in a first surface 6*a* of an orifice plate is to be formed, thus preferably is one which can be separated from the first DLC film and which has a flat surface. For example, the support substrate 18 is preferably any substrate obtained by subjecting a surface of a silicon substrate, a silicon oxide substrate, or the like to a mirror surface treatment. The first DLC film (first layer 10) is formed on the surface (mirror surface) of the support substrate 18, thus subjected to a mirror surface treatment. For example, a chemical vapor deposition method such as a plasma CVD method or a thermal CVD method, or a physical vapor deposition method (PVD method) such as a vacuum vapor deposition method or a sputtering method can be used as the method for forming the first DLC film, without any particular limitation.

Next, a second layer 11 is formed on the first DLC film provided on the support substrate 18. As described above, the second layer can be formed by use of a non-photosensitive material or a photosensitive material, and/or an organic material or an inorganic material. For example, the second layer 11 can be obtained by forming an inorganic film of diamond-like carbon, SiC, SiCN or the like on the first DLC film according to a chemical vapor deposition method such as a plasma CVD method or a thermal CVD method, or a physical vapor deposition method (PVD method) such as a vacuum vapor deposition method or a sputtering method. The second layer 11 can also be formed by thinning a Si substrate and pasting the substrate onto the first DLC film. Furthermore, the second layer 11 can also be formed by coating the first DLC film with a positive type resist or a negative type resist being SOG, polyimide or a photosensitive material, or forming a film of such a resist on the first DLC film, and subjecting the resultant to tenting.

Figure 3B:
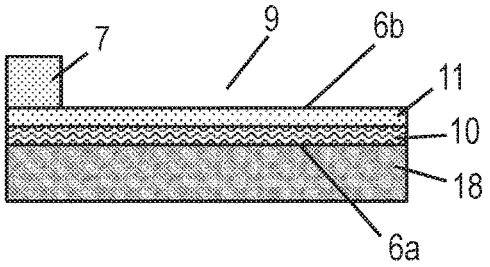
FIG. 3B is a schematic cross-sectional process flow for describing each step of a method for producing one embodiment of the liquid ejection head of the present invention.

Next, as illustrated in FIG. 3B, a flow path wall member 7 is formed on the second layer 11. The material included in the flow path wall member 7 is not particularly limited, and the material to be used may be the same as or different from the material of the second layer 11. In the case where the second layer and the flow path wall member are formed from the same material, a material layer having a thickness corresponding to the total thickness of two layers is formed on the first layer 10. The second layer 11 and the flow path wall member 7 can also be simultaneously formed by removing a portion to be formed into a flow path, from the material layer, according to etching or photolithography.

Figure 3C:
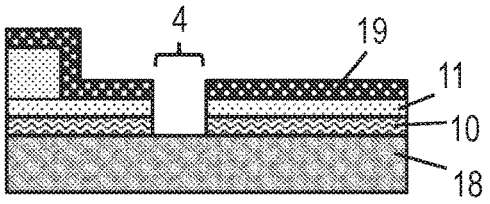
FIG. 3C is a schematic cross-sectional process flow for describing each step of a method for producing one embodiment of the liquid ejection head of the present invention.

Next, as illustrated in FIG. 3C, a photomask 19 is formed by a photosensitive resin or the like, and the mask is used to form an ejection orifice 4 penetrating through first the flow path wall member 7 and then the second layer 11 and the first layer 10. For example, in the case where the second layer 11 is a non-photosensitive material film, the ejection orifice penetrating through such layers can be formed by dry etching (RIE) using the photomask 19. Alternatively, in the case where the second layer 11 is a photosensitive material film, the ejection orifice can be formed by subjecting the second layer 11 to patterning according to photolithography and then dry etching (RIE) only the first layer 10. After the ejection orifice is formed, a non-volatile product is removed by oxygen ashing and the photomask 19 is removed.

Figure 3D:
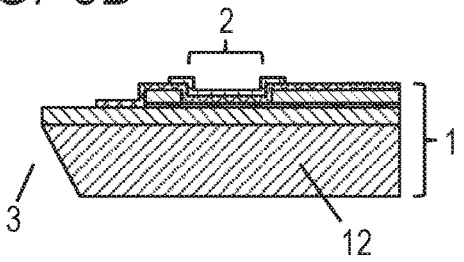
FIG. 3D is a schematic cross-sectional process flow for describing each step of a method for producing one embodiment of the liquid ejection head of the present invention.

Next, as illustrated in FIG. 3D, an element substrate 1 is prepared. Specifically, an energy-generating element 2 (for example, heater element), and an insulating protection film protecting the element, a heat accumulating layer, a drive circuit and the like are formed on a substrate 12 (for example, a silicon substrate) by a multi-wiring technique using photolithography. Subsequently, a liquid supply port 3 penetrating through the substrate 12 where the above element and the like are disposed, in a substantially vertical direction, is formed. The liquid supply port 3 can be formed by, for example, irradiating the substrate 12 with laser and performing anisotropic etching. In the case where the insulating protection film and the like are formed on the substrate 12, the liquid supply port 3 penetrating through the substrate 12 is formed by removing the insulating protection film and the like present in an opening portion of the liquid supply port, by RIE or the like.

Figure 3E:
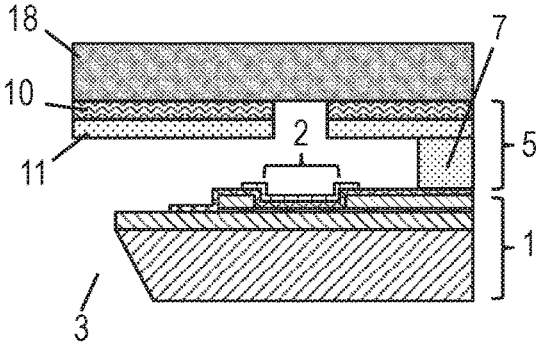
FIG. 3E is a schematic cross-sectional process flow for describing each step of a method for producing one embodiment of the liquid ejection head of the present invention.

Next, as illustrated in FIG. 3E, the support substrate where the flow path wall member and the like are disposed is pasted thereto in the state where the flow path wall member 7 faces the front surface of the element substrate 1.

Figure 3F:
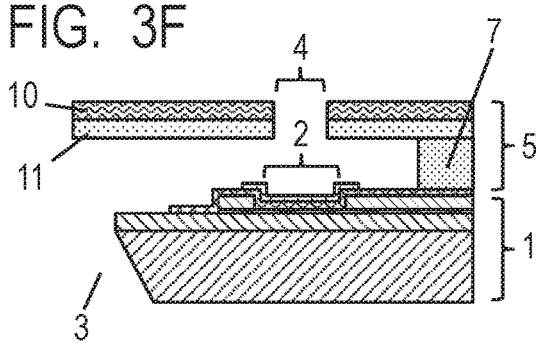
FIG. 3F is a schematic cross-sectional process flow for describing each step of a method for producing one embodiment of the liquid ejection head of the present invention.

Finally, as illustrated in FIG. 3F, the support substrate 18 is removed. For example, in the case where the support substrate 18 includes silicon oxide, the support substrate can be removed by etching with hydrofluoric acid. Alternatively, in the case where the support substrate 18 includes silicon, the thickness of the support substrate is 50 μm or less by, for example, grinding with a grinder or the like. Thereafter, the support substrate may be removed by etching with an etching liquid containing an alkali such as tetramethylammonium hydroxide (TMAH) or potassium hydroxide (KOH).

The liquid ejection head according to one embodiment of the present invention can be produced with the above steps.

EXAMPLES

The liquid ejection head of the present invention is described in more detail with reference to the following Examples. The present invention, however, is not intended to be limited to such Examples.

Example 1

First, as illustrated in FIG. 3A, a substrate obtained by subjecting a silicon oxide substrate to a mirror surface treatment was prepared as a support substrate 18. A first DLC film as a first layer 10 was formed on the mirror surface of the support substrate 18, according to a plasma CVD method. The power source was 13.56 MHz, the high-frequency output was 1000 W and the process gas was toluene ($C_7H_8$). The composition in a first surface 6*a* of the first DLC film was as follows: x1 was 20 at %, y1 was 40 at % and z1 was 40 at %; and was included in regions indicated by symbols A and C illustrated in FIGS. 4A and 4B. The thickness of the first DLC film was 1 μm, and the contact angle to pure water of the first surface was 70°.

Next, a second DLC film to be formed into a second layer 11 and a flow path wall member 7 was formed on the first DLC film according to an arc method. Here, carbon scattered from a target was removed by a filter. The thickness of the second DLC film was here 7 μm. The second DLC film was formed into a flow path wall member 7 and a second layer 11, as illustrated in FIG. 3B, by carving a portion serving as a flow path, by dry etching (ME) through a photomask (not illustrated) including a photosensitive resin material, and furthermore the mask was removed. The thickness of the second layer 11 was 2 μm, the total thickness of an orifice plate was 3 μm and the thickness (the height of the flow path) of the flow path wall member was 5 μm.

The composition in a second surface 6*b* of the second DLC film was as follows: x2 was 60 at %, y2 was 40 at % and z2 was 0 at %; and was included in a region indicated symbol B illustrated in FIG. 4A. The contact angle to pure water of the second surface including the second DLC film was here 40°.

Next, as illustrated in FIG. 3C, a photomask 19 including a photosensitive resin material was formed on the second layer 11 and the flow path wall member 7, and the mask was used to form an ejection orifice 4 penetrating through a foaming chamber 9 and then the second layer 11 and the first layer 10. Specifically, such layers were subjected to dry etching (RIE) with the mask, thereby forming the ejection orifice. Subsequently, a non-volatile product was removed by oxygen ashing. Film thickness measurement was performed by an X-ray reflectivity technique (XRR), and both the first layer and the second layer of the orifice plate did not undergo film reduction due to ashing. Furthermore, the photomask 19 was removed.

Next, as illustrated in FIG. 3D, a heater element including TaSiN, as an energy-generating element 2, an insulating protection film including SiN and a cavitation-resistant film including Ta were formed on a substrate 12. Subsequently, a liquid supply port 3 penetrating through the substrate 12 where the above element and the like were disposed, in a substantially vertical direction, was formed by anisotropic etching. The insulating protection film and the like present in an opening portion of the liquid supply port on the substrate 12 were removed by RIE and the substrate 12 was allowed to penetrate through the liquid supply port 3, thereby producing an element substrate.

Next, as illustrated in FIG. 3E, both the element substrate 1 illustrated in FIG. 3D and the member illustrated in FIG. 3C were pasted to each other so that the flow path wall member 7 was in contact with the front surface of the element substrate.

Finally, as illustrated in FIG. 3F, the support substrate 18 was removed by etching with hydrofluoric acid.

Each liquid ejection head illustrated in FIG. 2A and FIG. 3F was produced according to the above steps. The resulting liquid ejection head was evaluated with respect to the following respective evaluation items. The evaluation results are shown in Table 1.

Favorable results were obtained with respect to the respective evaluation items in Example 1. In Example 1, the contact angle of the surface (second surface) in contact with the foaming chamber could be small with the contact angle of the outermost surface (first surface) of the orifice plate being kept large. Thus, a liquid could be easily spread in the foaming chamber to thereby allow bubbles to be hardly accumulated, resulting in stabilization of the amount of ejection of a droplet.

Warpage of Substrate

Whether or not warpage of the substrate was generated was determined in all the steps in production of the liquid ejection head, by use of a stress measuring instrument, and was evaluated according to the following criteria.

Evaluation Criteria

A: Warpage of the substrate, enabling no processing, was not generated in all the steps, that is, at the stage where the liquid ejection head was obtained.

B: Warpage of the substrate was not generated at the stage where the DLC film was formed, but warpage of the substrate, enabling no processing, was generated in other step(s), that is, at the stage where the liquid ejection head was obtained.

C: Warpage of the substrate, enabling no processing, was generated at the stage where the DLC film was formed.

Film Reduction

Film thickness measurement (after ashing) was performed by XRR, and whether or not the layers (in particular, the first surface and the second surface) included in the orifice plate underwent film reduction due to ashing was evaluated according to the following criteria.

Evaluation Criteria

A: No film reduction of the orifice plate due to ashing.

B: Slight film reduction of the orifice plate due to ashing.

C: Medium or severe film reduction of the orifice plate due to ashing.

Cracking and/or Peeling of Orifice Plate

The resulting liquid ejection head was observed by an automatic visual inspection apparatus, and whether or not cracking and/or peeling of the orifice plate were/was generated was evaluated according to the following criteria.

Evaluation Criteria

A: Cracking and peeling of the orifice plate were not generated.

B: Slight cracking and/or peeling of the orifice plate were/was generated.

C: Medium or severe cracking and/or peeling of the orifice plate were/was generated.

Meniscus

The resulting liquid ejection head was used to eject a liquid onto a recording medium (high quality exclusive paper manufactured by Canon Inc.), thereby producing a print product, thereafter the surface of the head was observed with a microscope, and whether or not liquid overflow from the ejection orifice was observed was evaluated according to the following criteria.

Evaluation Criteria

A: No liquid overflow from the ejection orifice after printing.

B: Liquid overflow from the ejection orifice after printing.

Dripping

The print product was observed with a printing inspection apparatus, and whether or not liquid dripping was observed was evaluated according to the following criteria.

Evaluation Criteria

A: Liquid dripping in the print product was not observed.

B: Liquid dripping in the print product was observed.

Bubble Accumulation

The droplet size on the print product was observed with a printing inspection apparatus, and whether or not the droplet size was uniform was evaluated according to the following criteria.

A: The droplet size was uniform.

B: The droplet size was non-uniform at a level where an image printed was not affected.

C: The droplet size was non-uniform at a level where an image printed was affected.

Example 2

A liquid ejection head illustrated in FIG. 2A was produced in the same manner as in Example 1 except that the following change was made.

Specifically, the high-frequency output was changed from 1000 W to 100 W in formation of the first DLC film on the mirror surface of the support substrate 18 according to a plasma CVD method. Thus, the composition in the first surface 6*a* of the first DLC film was as follows: x1 was 20 at %, y1 was 20 at % and z1 was 60 at %; and was within region A illustrated in FIG. 4A. The contact angle to pure water of the first surface 6*a* was 80°.

The resulting liquid ejection head was evaluated with respect to the above respective evaluation items. The evaluation results are shown in Table 1. It was here confirmed by film thickness measurement in Example 2 that the first layer (first DLC film) of the orifice plate was reduced in film thickness by several percentages due to ashing. The reason for such a reduction was considered to be because the content of hydrogen in the first DLC film included in the first surface was higher than the content of hydrogen in Example 1, which easily caused oxygen ashing. In Example 2, however, the contact angle of the surface in contact with the foaming chamber could be small with the contact angle of the outermost surface of the orifice plate being kept large, while the degree of film reduction of the first DLC film was rated inferior to the degree in Example 1. Accordingly, a liquid could be easily spread in the foaming chamber to thereby allow bubbles to be hardly accumulated, resulting in stabilization of the amount of ejection of a droplet.

Example 3

A liquid ejection head illustrated in FIG. 2A was produced in the same manner as in Example 1 except that the following change was made.

Specifically, the second DLC film to be formed into a second layer 11 and a flow path wall member 7, produced on the first DLC film in Example 1, was changed to a SiCN (silicon carbonitride) film formed according to a plasma CVD method. The SiCN film was formed by use of $SiH_4$ gas, $NH_3$ gas, $N_2$ gas and $CH_4$ gas streams. The HRF power was 800 W, the LRF power was 40 W and the pressure was 1000 Pa. The SiCN film was used to produce a second layer 11 and a flow path wall member 7 in the same manner as in Example 1. The contact angle to pure water of the second surface including the SiCN film was here 30°.

The resulting liquid ejection head was evaluated with respect to the above respective evaluation items. The evaluation results are shown in Table 1. Favorable results were obtained with respect to the respective evaluation items in Example 3. In Example 3, the contact angle of the surface in contact with the foaming chamber could be small with the contact angle of the outermost surface of the orifice plate being kept large. Thus, a liquid could be easily spread in the foaming chamber to thereby allow bubbles to be hardly accumulated, resulting in stabilization of the amount of ejection of a droplet.

Example 4

A liquid ejection head illustrated in FIG. 2A was produced in the same manner as in Example 1 except that the following change was made.

Specifically, the second DLC film produced on the first DLC film in Example 1 was changed to a Si substrate. In other words, a Si substrate was bonded onto the first DLC film. After the bonding, the Si substrate was polished until the thickness was 7 μm. The Si substrate was then subjected to dry etching (RIE) through a photomask (not illustrated), thereby forming a second layer 11 and a flow path wall member 7. The contact angle to pure water of the second surface 6*b* including the Si substrate was 20°.

The resulting liquid ejection head was evaluated with respect to the above respective evaluation items. The evaluation results are shown in Table 1. Favorable results were obtained with respect to the respective evaluation items in Example 4. In Example 4, the contact angle of the surface in contact with the foaming chamber could be small with the contact angle of the outermost surface of the orifice plate being kept large. Thus, a liquid could be easily spread in a liquid chamber to thereby allow bubbles to be hardly accumulated, resulting in stabilization of the amount of ejection of a droplet.

Example 5

Next, a liquid ejection head illustrated in FIG. 2A was produced in the same manner as in Example 2 except that the following change was made.

Specifically, the second DLC film produced on the first DLC film in Example 2 was changed to a photosensitive positive type resist layer produced according to a spin coating method. The thickness of the resist layer was 20 μm and a portion to be formed into a flow path by photolithography through a photomask (not illustrated) including a photosensitive resin material was subjected to patterning, thereby forming a flow path wall member 7 and a second layer 11. The thickness of the second layer 11 was 10 μm, the total thickness of an orifice plate was 11 μm and the thickness of the flow path wall member was 10 μm.

The photosensitive positive type resist included a hydrophilic monomer and thus the contact angle to pure water of the second surface including the resist was 50°.

In formation of an ejection orifice 4, the second layer 11 was subjected to patterning by photolithography and subsequently only the first layer 10 was carved by dry etching (ME), thereby forming such an ejection orifice.

The resulting liquid ejection head was evaluated with respect to the above respective evaluation items. The evaluation results are shown in Table 1. In Example 5, the difference in linear coefficient of expansion between the first layer 10 and the second layer 11 could be small as compared with other Examples and thus peeling-off and the like of the orifice plate could be easily prevented. Film thickness measurement was performed by XRR after ashing, and both the first layer and the second layer of the orifice plate were found not to undergo film reduction due to ashing. In Example 5, the second layer included the photosensitive material and thus could be processed by not dry etching, but photolithography, and thus any effect due to ashing could be further suppressed. Thus, in Example 5, the contact angle of the surface in contact with the foaming chamber could be small with the contact angle of the outermost surface of the orifice plate being kept large. Thus, a liquid could be easily spread in the foaming chamber to thereby allow bubbles to be hardly accumulated, resulting in stabilization of the amount of ejection of a droplet.

Example 6

Next, a liquid ejection head illustrated in FIG. 2A was produced in the same manner as in Example 5 except that the following change was made.

Specifically, the high-frequency output was changed from 100 W to 1500 W in formation of the first DLC film on the mirror surface of the support substrate 18 according to a plasma CVD method. Thus, the composition in the first surface 6*a* of the first DLC film was as follows: x1 was 40 at %, y1 was 40 at % and z1 was 20 at %; and was within region A illustrated in FIG. 4A. The contact angle to pure water of the first surface 6*a* was 60°.

The resulting liquid ejection head was evaluated with respect to the above respective evaluation items. The evaluation results are shown in Table 1. The liquid ejection head obtained in Example 6 was large in the difference in linear coefficient of expansion between the first layer and the second layer, as compared with Example 5. Thus, the resulting liquid ejection head was observed with a microscope, and it was found that cracking and interface peeling-off were generated on the first surface of the orifice plate with a probability of about several percentages. Product performance, however, was not substantially affected. In addition, although the amount of warpage of the entire substrate was large in Example 6, as compared with other Examples, to result in a need for an enhancement in stage adsorption power during substrate processing, product performance in post-processing was not substantially affected. Film thickness measurement was performed by XRR after ashing, and both the first layer and the second layer of the orifice plate were found not to undergo film reduction due to ashing. As in Example 5, the second layer included the photosensitive material and thus could be processed by not dry etching, but photolithography, and thus any effect due to ashing could be further suppressed. In Example 6, however, the contact angle of the surface in contact with the foaming chamber could be small with the contact angle of the outermost surface of the orifice plate being kept large, while the degrees of cracking and interface peeling-off of the orifice plate and the amount of warpage of the entire substrate were rated inferior to the degrees in Example 5. Thus, a liquid could be easily spread in the foaming chamber to thereby allow bubbles to be hardly accumulated, resulting in stabilization of the amount of ejection of a droplet.

Example 7

A liquid ejection head illustrated in FIG. 2B was produced in the same manner as in Example 1 except that the following change was made.

Specifically, a DLC film to be formed into an orifice plate was formed on the mirror surface of the support substrate 18 subjected to a mirror surface treatment, illustrated in FIG. 3A, according to a plasma CVD method. The power source was 13.56 MHz and the process gas was toluene ($C_7H_8$). Film formation was performed with a gradual increase in high-frequency output from 1000 W up to 2000 W, and thus a DLC film including a first surface 6*a* and a second surface 6*b* was formed. The thickness of the orifice plate including the DLC film was here 3 μm.

The composition in the first surface including the DLC film was as follows: x1 was 20 at %, y1 was 40 at % and z1 was 40 at %; and was within regions A and C illustrated in FIG. 4A and FIG. 4B. The composition in the second surface including the DLC film was as follows: x2 was 50 at %, y2 was 40 at % and z2 was 10 at %; and was within region B illustrated in FIG. 4A. The contact angle to pure water of the first surface 6*a* was 70°, and the contact angle to pure water of the second surface 6*b* was 55°. The DLC film was gradually increased in the content rate of $sp^3$ hybrid orbital species, toward the second surface from the first surface, and was gradually decreased in the linear coefficient of expansion like gradation.

Subsequently, as illustrated in FIG. 3B, a flow path wall member 7 was formed on the second surface of the DLC film, by use of a Si substrate. Specifically, a Si substrate was bonded onto the second surface, and the Si substrate was polished until the thickness was 5 μm. The Si substrate was then subjected to dry etching (ME) through a photomask (not illustrated), thereby forming a flow path wall member 7. The thickness (the height of the flow path) of the flow path wall member was 5 μm.

The resulting liquid ejection head was evaluated with respect to the above respective evaluation items. The evaluation results are shown in Table 1. In Example 7, the linear coefficient of expansion could be gradually decreased toward the second surface from the first surface of the orifice plate and thus cracking and interface peeling-off of the orifice plate and warpage of the entire substrate could be further suppressed. In Example 7, the contact angle of the surface in contact with the foaming chamber could be small with the contact angle of the outermost surface of the orifice plate being kept large, and a liquid could be easily spread in the foaming chamber to thereby allow bubbles to be hardly accumulated, resulting in stabilization of the amount of ejection of a droplet.

Example 8

A liquid ejection head illustrated in FIG. 2A was produced in the same manner as in Example 1 except that the following change was made. Specifically, in formation of a second DLC film according to an arc method, the composition in a second surface including the second DLC film was changed so that x2 was 80 at %, y2 was 20 at % and z2 was 0 at %. The contact angle to pure water of the second surface was 35°.

The resulting liquid ejection head was evaluated with respect to the above respective evaluation items. The evaluation results are shown in Table 1. The liquid ejection head obtained in Example 8 was large in the difference in linear coefficient of expansion between two layers included in the orifice plate, as compared with Examples 5 and 6, etc. Thus, the liquid ejection head was observed with a microscope, and it was confirmed that cracking and interface peeling-off were generated on the first surface of the orifice plate with a probability of about 10%. Product performance, however, was not substantially affected. In addition, although the amount of warpage of the entire substrate was increased to result in a need for an enhancement in stage adsorption power during substrate processing, product performance in post-processing was not substantially affected. Thus, in Example 8, the contact angle of the surface in contact with the foaming chamber could be small with the contact angle of the outermost surface of the orifice plate being kept large, while the degrees of cracking and interface peeling-off of the orifice plate and the amount of warpage of the entire substrate were rated inferior to the degrees in Examples 5 and 6, etc. Thus, a liquid could be easily spread in the foaming chamber to thereby allow bubbles to be hardly accumulated, resulting in stabilization of the amount of ejection of a droplet.

Comparative Example 1

Figure 5:
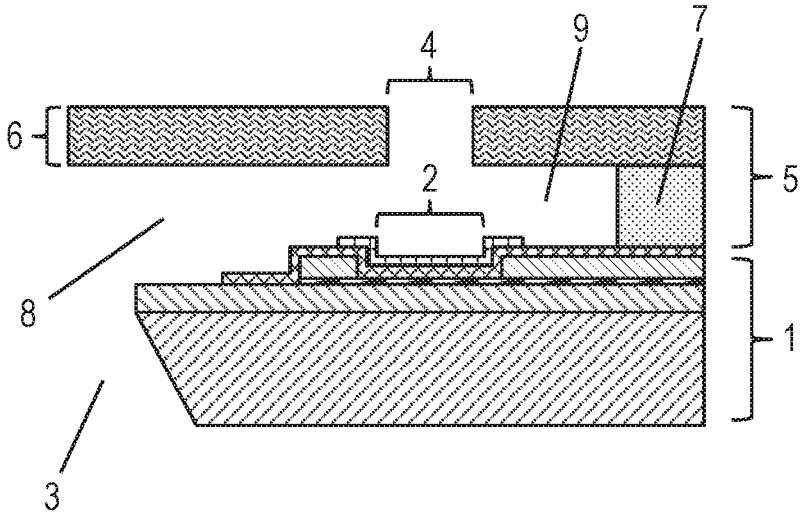
FIG. 5 is a schematic partial cross-sectional view for describing a conventional liquid ejection head.

A conventional liquid ejection head illustrated in FIG. 5 was produced in the same manner as in Example 1 except that the following change was made.

Specifically, a DLC film to be formed into an orifice plate 6 having a thickness of 3 μm was formed on the mirror surface of the support substrate 18 subjected to a mirror surface treatment, illustrated in FIG. 3A, according to a plasma CVD method. The power source was 13.56 MHz, the high-frequency output was 100 W and the process gas was toluene ($C_7H_8$). The compositions in a first surface and a second surface of the orifice plate including the DLC film were as follows: both x1 and x2 were 20 at %, both y1 and y2 were 40 at % and both z1 and z2 were 40 at %. In other words, the orifice plate, from the first surface to the second surface, had the same composition. The contact angles to pure water of the first surface and the second surface were here 70°. A flow path wall member 7 was formed so as to have a thickness of 5 μm, by use of the second DLC film illustrated in Example 1 in the same manner as in Example 1.

The resulting liquid ejection head was evaluated with respect to the above respective evaluation items. The evaluation results are shown in Table 1. The droplet size of a print product made for evaluation was observed with a printing inspection apparatus, and it was found that a case of no ejection or a small droplet size was caused at a proportion of about 40% in the total and such a proportion exceeded the range not causing any problems in terms of printing performance. The reason was considered because a surface of the orifice plate, the surface being in contact with the foaming chamber, also had water repellency to thereby cause air bubbles to be easily accumulated in the foaming chamber, resulting in a decrease in the amount of ejection. Thus, the quality of the product was inferior to the qualities in Examples 1 to 8, as shown in Table 1.

Comparative Example 2

A liquid ejection head was produced in the same manner as in Example 1 except that the following change was made.

Specifically, a first DLC film was formed on the mirror surface of the support substrate 18 subjected to a mirror surface treatment, according to a vacuum vapor deposition method. The composition in a first surface of the first DLC film was as follows: x1 was 10 at %, y1 was 10 at % and z1 was 80 at %; and was not within region A illustrated in FIG. 4A. The thickness of the first DLC film was 1 μm, and the contact angle to pure water was 100°.

The resulting liquid ejection head was evaluated with respect to the above respective evaluation items. The evaluation results are shown in Table 1. It was here confirmed by film thickness measurement in Comparative Example 2 that the first layer (the first DLC film) was reduced in thickness by 80% or more due to ashing. The reason for such a reduction was considered because a higher content of hydrogen in the first surface easily caused oxygen ashing. In Comparative Example 2, a print product made for evaluation was observed with a printing inspection apparatus, and it was found that liquid dripping was caused at a rate of about 20% and such a rate exceeded the range not causing any problems in terms of printing performance. The reason was considered because the contact angle to pure water of the first surface was 100° to thereby cause an unnecessary droplet generated in printing and attached to the first surface to drop onto the print product before wiping off and removal of the droplet. Thus, the quality of the product was inferior to the qualities in Examples 1 to 8, as shown in Table 1.

Comparative Example 3

A liquid ejection head was produced in the same manner as in Example 1 except that the following change was made.

Specifically, a first DLC film was formed on the mirror surface of the support substrate 18 subjected to a mirror surface treatment, according to a DC sputtering method. The composition in a first surface of the first DLC film was as follows: x1 was 10 at %, y1 was 80 at % and z1 was 10 at %; and was not within region A illustrated in FIG. 4A. The thickness of the first DLC film was 1 μm, and the contact angle to pure water was 100°.

The resulting liquid ejection head was evaluated with respect to the above respective evaluation items. The evaluation results are shown in Table 1. In Comparative Example 3, a print product made for evaluation was observed with a printing inspection apparatus, and it was found that liquid dripping was caused at a rate of about 20% and such a rate exceeded the range not causing any problems in terms of printing performance. The reason was considered because the contact angle to pure water of the first surface was 100° to thereby cause an unnecessary droplet generated in printing and attached to the first surface to drop onto the print product before wiping off and removal of the droplet. Thus, the quality of the product was inferior to the qualities in Examples 1 to 8, as shown in Table 1.

Comparative Example 4

A liquid ejection head was produced in the same manner as in Example 1 except that the following change was made.

Specifically, a DLC film to be formed into an orifice plate having a thickness of 3 μm was formed on the mirror surface of the support substrate 18 subjected to a mirror surface treatment, illustrated in FIG. 3A, according to an arc method. The compositions in a first surface and a second surface each including the DLC film were as follows: both x1 and x2 were 60 at %, both y1 and y2 were 40 at % and both z1 and z2 were 0 at %. In other words, the orifice plate, from the first surface to the second surface, had the same composition. The respective contact angles to pure water, of the first surface and the second surface, were 40°. A flow path wall member 7 was formed so as to have a thickness of 5 μm, by use of the second DLC film illustrated in Example 1 in the same manner as in Example 1.

The resulting liquid ejection head was evaluated with respect to the above respective evaluation items. The evaluation results are shown in Table 1. In Comparative Example 4, the surface of the head was observed with a microscope, and thus liquid overflow from the ejection orifice was confirmed and was caused at a proportion of about 30% in the total nozzles. Such liquid overflow caused any droplet generated later to be deviated, and such a result exceeded the range not causing any problems in terms of printing performance. The reason was because the contact angle to pure water, of the first surface, was small to cause meniscus not to be stabilized. Thus, the quality of the product was inferior to the qualities in Examples 1 to 8, as shown in Table 1.

TABLE 1

| | | Orifice plate | | | | | |
|---|---|---|---|---|---|---|---|
| | | First surface | | | Second surface | | |
| | | Material | Composition (at %) (x1, y1, z1) | Contact angle $\theta_1$ | Material | Composition (at %) (x2, y2, z2) | Contact angle $\theta_2$ |
| Example | 1 | DLC | 20, 40, 40 | 70° | DLC | 60, 40, 0 | 40° |
| | 2 | DLC | 20, 20, 60 | 80° | DLC | 60, 40, 0 | 40° |
| | 3 | DLC | 20, 40, 40 | 70° | SiCN | — | 30° |
| | 4 | DLC | 20, 40, 40 | 70° | Si | — | 20° |
| | 5 | DLC | 20, 20, 60 | 80° | Resist | — | 50° |

TABLE 1-continued

| | | | | | | | |
|---|---|---|---|---|---|---|---|
| | 6 | DLC | 40, 40, 20 | 60° | Resist | — | 50° |
| | 7 | DLC | 20, 40, 40 | 70° | DLC | 50, 40, 10 | 55° |
| | 8 | DLC | 20, 40, 40 | 70° | DLC | 80, 20, 0 | 35° |
| Comparative | 1 | DLC | 20, 40, 40 | 70° | DLC | 20, 40, 40 | 70° |
| Example | 2 | DLC | 10, 10, 80 | 100° | DLC | 60, 40, 0 | 40° |
| | 3 | DLC | 10, 80, 10 | 100° | DLC | 60, 40, 0 | 40° |
| | 4 | DLC | 60, 40, 0 | 40° | DLC | 60, 40, 0 | 40° |

| | | Evaluation results | | | | | |
|---|---|---|---|---|---|---|---|
| | | Meniscus | Dripping | Bubble accumulation | Cracking and/or peeling of orifice plate | Warpage of substrate | Film reduction |
| Example | 1 | A | A | A | A | A | A |
| | 2 | A | A | A | A | A | B |
| | 3 | A | A | A | A | A | A |
| | 4 | A | A | A | A | A | A |
| | 5 | A | A | A | A | A | A |
| | 6 | A | A | A | B | B | A |
| | 7 | A | A | A | A | A | A |
| | 8 | A | A | A | B | B | A |
| Comparative | 1 | A | A | C | A | A | A |
| Example | 2 | A | B | A | A | A | C |
| | 3 | A | | A | A | A | A |
| | 4 | B | A | A | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-210574, filed Nov. 8, 2018, which is hereby incorporated by reference herein in its entirety.

What is claimed is:

1. A liquid ejection head comprising:

an orifice plate comprising an ejection orifice which ejects a liquid;

an element substrate comprising an energy-generating element for ejection of a liquid from the ejection orifice; and a flow path wall member for formation of a flow path in communication with the ejection orifice, the flow path wall member being disposed between the element substrate and the orifice plate; wherein the orifice plate comprises a first surface and a second surface which is opposite to the first surface and which is disposed facing the element substrate, and the first surface comprises a first diamond-like carbon film;

respective contact angles $\theta_1$ and $\theta_2$ to pure water of the first surface and the second surface satisfy a relationship of the following Expression 1; and composition in the first surface of the first diamond-like carbon film satisfies all relationships of the following Expression 2 to Expression 5:

$\theta_2<\theta_1<100°$ Expression 1:

0 at %$\leq x1\leq$50 at % Expression 2:

0 at %$\leq y1\leq$70 at % Expression 3:

0 at %$\leq z1\leq$70 at % Expression 4:

$x1+y1+z1$=100 at % Expression 5:

wherein x1, y1 and z1 represent content rates of $sp^3$ hybrid orbital species, $sp^2$ hybrid orbital species and a hydrogen atom in the first diamond-like carbon film, respectively.

2. The liquid ejection head according to claim 1, wherein the second surface of the orifice plate comprises a non-photosensitive material film.

3. The liquid ejection head according to claim 2, wherein the non-photosensitive material film comprises at least one selected from the group consisting of diamond-like carbon, SiC, SiCN, Si, SOG and polyimide.

4. The liquid ejection head according to claim 2, wherein the second surface of the orifice plate comprises a second diamond-like carbon film; and composition in the second surface of the second diamond-like carbon film satisfies all relationships of the following Expression 6 to Expression 9:

50 at %$\leq x2\leq$80 at % Expression 6:

0 at %$\leq y2\leq$50 at % Expression 7:

0 at %$\leq z2\leq$50 at % Expression 8:

$x2+y2+z2$=100 at % Expression 9:

wherein x2, y2 and z2 represent content rates of $sp^3$ hybrid orbital species, $sp^2$ hybrid orbital species and a hydrogen atom in the second diamond-like carbon film, respectively.

5. The liquid ejection head according to claim 2, wherein the composition in the first surface of the first diamond-like carbon film satisfies all relationships of the following Expression 10 to Expression 13:

0 at %$\leq x1\leq$50 at % Expression 10:

0 at %$\leq y1\leq$70 at % Expression 11:

0 at %$\leq z1\leq$50 at % Expression 12:

$x1+y1+z1$=100 at % Expression 13:

wherein x1, y1 and z1 represent content rates of $sp^3$ hybrid orbital species, $sp^2$ hybrid orbital species and a hydrogen atom in the first diamond-like carbon film, respectively.

6. The liquid ejection head according to claim 1, wherein the second surface comprises a photosensitive material film.

7. The liquid ejection head according to claim 6, wherein the photosensitive material film comprises a positive type resist or a negative type resist.

8. The liquid ejection head according to claim 6, wherein the composition in the first surface of the first diamond-like carbon film satisfies all relationships of the following Expression 14 to Expression 17 or the following Expression 17 to Expression 20:

$$0 \text{ at } \% \leq x1 \leq 30 \text{ at } \% \quad \text{Expression 14:}$$

$$0 \text{ at } \% \leq y1 \leq 70 \text{ at } \% \quad \text{Expression 15:}$$

$$0 \text{ at } \% \leq z1 \leq 70 \text{ at } \% \quad \text{Expression 16:}$$

$$x1+y1+z1=100 \text{ at } \% \quad \text{Expression 17:}$$

$$30 \text{ at } \% \leq x1 \leq 50 \text{ at } \% \quad \text{Expression 18:}$$

$$0 \text{ at } \% \leq y1 \leq 20 \text{ at } \% \quad \text{Expression 19:}$$

$$50 \text{ at } \% \leq z1 \leq 70 \text{ at } \% \quad \text{Expression 20:}$$

wherein x1, y1 and z1 represent content rates of $sp^3$ hybrid orbital species, $sp^2$ hybrid orbital species and a hydrogen atom in the first diamond-like carbon film, respectively.

9. The liquid ejection head according to claim 2, wherein a film comprised in the second surface has a thickness of 1 μm or more in the second surface.

10. The liquid ejection head according to claim 1, wherein the orifice plate comprises a diamond-like carbon film; and a contact angle to pure water of the diamond-like carbon film is gradually decreased toward the second surface from the first surface.

11. The liquid ejection head according to claim 1, wherein the second surface comprises an inorganic film; and the orifice plate has a thickness of 5 μm or less.

12. The liquid ejection head according to claim 1, wherein the second surface comprises an organic film; and the orifice plate has a thickness of 5 μm or more.

13. The liquid ejection head according to claim 1, wherein the contact angle $\theta_1$ to pure water of the first surface is more than 60°.

* * * * *